US009075397B2

(12) United States Patent
Girardbille et al.

(10) Patent No.: US 9,075,397 B2
(45) Date of Patent: Jul. 7, 2015

(54) CHRONOGRAPH MECHANISM

(75) Inventors: Alain Girardbille, La Chaux-de-Fonds (CH); Hugo Lopez, Corgemont (CH); Demetrio Cabiddu, Le Sentier (CH)

(73) Assignee: RICHEMONT INTERNATIONAL S.A., Villars-Sur-Glane (CH)

( * ) Notice: Subject to any disclaimer, the term of this patent is extended or adjusted under 35 U.S.C. 154(b) by 211 days.

(21) Appl. No.: 13/441,384

(22) Filed: Apr. 6, 2012

(65) Prior Publication Data

US 2012/0257480 A1 Oct. 11, 2012

(30) Foreign Application Priority Data

Apr. 8, 2011 (CH) ..... 0641/11

(51) Int. Cl.

| | |
|---|---|
| ***G04F 7/00*** | (2006.01) |
| ***G04B 19/04*** | (2006.01) |
| ***G04B 19/06*** | (2006.01) |
| ***G04F 1/00*** | (2006.01) |
| ***G04F 7/08*** | (2006.01) |
| ***G04F 7/06*** | (2006.01) |

(52) U.S. Cl.

CPC ..... *G04F 7/088* (2013.01); *G04B 19/04* (2013.01); *G04F 7/06* (2013.01); *G04F 7/0866* (2013.01); *G04F 7/08* (2013.01); *G04F 7/0876* (2013.01); *G04F 7/00* (2013.01); *G04F 7/0871* (2013.01)

(58) Field of Classification Search

CPC ..... G04B 19/04; G04F 7/08; G04F 7/0866; G04F 7/0871; G04F 7/0876; G04F 7/088

USPC ..... 368/80, 89–99, 101–106

See application file for complete search history.

(56) References Cited

U.S. PATENT DOCUMENTS

| | | | | |
|---|---|---|---|---|
| 1,350,131 | A * | 8/1920 | Anderson | 368/220 |
| 4,270,197 | A * | 5/1981 | Minowa | 368/102 |
| 5,339,293 | A * | 8/1994 | Kamiyama et al. | 368/21 |
| 6,567,345 | B1 * | 5/2003 | Furukawa et al. | 368/80 |
| 7,974,156 | B2 * | 7/2011 | Papi et al. | 368/80 |
| 8,066,428 | B2 * | 11/2011 | Behling | 368/102 |

(Continued)

FOREIGN PATENT DOCUMENTS

CH 697433 10/2008

OTHER PUBLICATIONS

First Look: Mikrotimer Flying 1000, Mar. 24, 2011, Calibre 11, <http://www.calibre11.com/tag-heuer-mikrotimer-flying-1000/>, pp. 1-5.*

*Primary Examiner* — Amy Cohen Johnson
*Assistant Examiner* — Daniel Wicklund
(74) *Attorney, Agent, or Firm* — Young & Thompson

(57) ABSTRACT

The chronograph mechanism includes a control device and a chronograph gear train designed to be driven directly or indirectly by a barrel, this chronograph gear train including a second-counter mobile and a mobile with a first precision corresponding to a first fraction of a second. The chronograph mechanism also includes at least one indicator which displays the seconds and first fractions of a second of the duration measured. The chronograph gear train includes an additional mobile (5) with a second precision corresponding to a second fraction of a second, which is driven by the mobile (3) for the first fraction of a second by a mobile (4) compensating the backlash; and the chronograph mechanism also includes an indicator for the second fractions of a second, which are smaller than the first fractions of a second, of the duration measured, which indicator is actuated by the additional train.

12 Claims, 9 Drawing Sheets

(56) References Cited

U.S. PATENT DOCUMENTS

2008/0106979 A1* 5/2008 Bron et al. ..... 368/34
2009/0103398 A1* 4/2009 Robin ..... 368/80
2011/0096635 A1* 4/2011 Calabrese ..... 368/127
2011/0164477 A1* 7/2011 Jolidon ..... 368/106
2012/0243386 A1* 9/2012 Semon ..... 368/129

* cited by examiner

CHRONOGRAPH MECHANISM

The present invention relates to chronograph mechanisms, and more particularly to the chronograph mechanisms which are designed to equip mechanical timepieces.

The object of the prevent invention is to provide a chronograph mechanism which is entirely mechanical, and makes it possible to measure durations with high precision, and preferably a precision greater than a hundredth of a second, for example a thousandth of a second, whilst maximising the power reserve of the mechanism and avoiding premature wear of its components.

BACKGROUND OF THE INVENTION

At the end of March 2011, the brand Tag Heuer presented a mechanical chronograph design (named the Mikrotimer Flying 1000) which is reputed to be capable of measuring and displaying thousandths of a second. According to the information available, this chronograph mechanism comprises a regulator unit in the form of a spring which oscillates at a frequency of 500 Hz, i.e. 3,600,000 alternations per hour. The chronograph display comprises two central hands. The first hand performs 10 rotations per second, indicating the thousandths and hundredths of a second on a scale of 100 graduations around 360°. A second, smaller, central hand indicates the minutes and twelfths of a minute on a scale of 150 seconds.

However, this chronograph mechanism is very complicated, since it differs from the conventional horological regulator in the form of a spring balance. Also, because of the high frequency of the oscillator, the chronograph mechanism uses a large amount of energy, resulting in the fact that it has a power reserve of only 150 seconds. This high frequency can also give rise to premature wear of the components of the chronograph mechanism. In addition, since the display of the chronograph counter is not produced entirely on a decimal basis, it is difficult for the user to read easily and immediately the time which has passed.

SUMMARY OF THE INVENTION

In order to alleviate these disadvantages, the object of the present invention is a chronograph mechanism comprising a control device and chronograph gear train which are designed to be driven directly or indirectly by a barrel, this chronograph gear train comprising a second-counter mobile and a mobile with a first precision corresponding to a first fraction of a second; this chronograph mechanism also comprising at least one indicator which displays the seconds and first fractions of a second of the duration measured; the chronograph gear train comprising an additional mobile with a second precision corresponding to a second fraction of a second, which is driven by the mobile for the first fraction of a second by means of a mobile compensating the backlash; and the chronograph mechanism also comprising an indicator for the second fractions of a second, which are smaller than the first fractions of a second, of the duration measured, which indicator is actuated by the said additional mobile.

The object of the present invention is also a mechanical timepiece, for example a pocket watch or a wristwatch, provided with a chronograph mechanism according to that described in claim 1.

BRIEF DESCRIPTION OF THE DRAWINGS

The appended drawing illustrates schematically and by way of example a part of the chronograph mechanism according to the invention, and a wristwatch provided with a chronograph mechanism of this type.

DETAILED DESCRIPTION OF THE PREFERRED EMBODIMENTS

The present chronograph mechanism comprising a control device with one or two push-buttons which permit control of the start, stop and resetting functions, and chronograph gear train which drive the different counters, i.e. minute counters, second counters etc., can be of the type with a column wheel or cam. Furthermore, this chronograph mechanism can be designed to equip either a conventional timepiece, in which case the chronograph gear train is driven indirectly by the drive barrel of the timepiece, or a timepiece such as described for example in document CH 697433, in which case the chronograph gear train is driven directly by a chronograph barrel which is separate from the drive barrel of the timepiece.

In fact, the present chronograph mechanism is distinguished from the existing chronograph mechanisms in that it is designed such as to be able to measure and display durations with a first precision corresponding to a first fraction of a second (for example hundredths of a second) as well as with a second precision corresponding to a second fraction of a second which is smaller than the first one (for example thousandths of a second), the mobile used to count the first fractions controlling an additional mobile which is used to count the second fractions by means of a mobile compensating the backlash. By this means, the mechanism can comprise a regulator unit which oscillates at a frequency corresponding to the first precision, without needing a regulator unit which oscillates at a higher frequency.

A preferred embodiment of the chronograph mechanism makes it possible to measure durations with precision of a thousandths of a second on the basis of a counter for hundredths of a second.

The present chronograph mechanism is differentiated from the known chronograph mechanisms in that its gear train and control device comprise novel and original characteristics.

Consequently, hereinafter only the chronograph gear train and part of the control device of the chronograph will be described in detail, the remainder of the chronograph mechanism being conventional and well known to persons skilled in the art.

Figure 3:
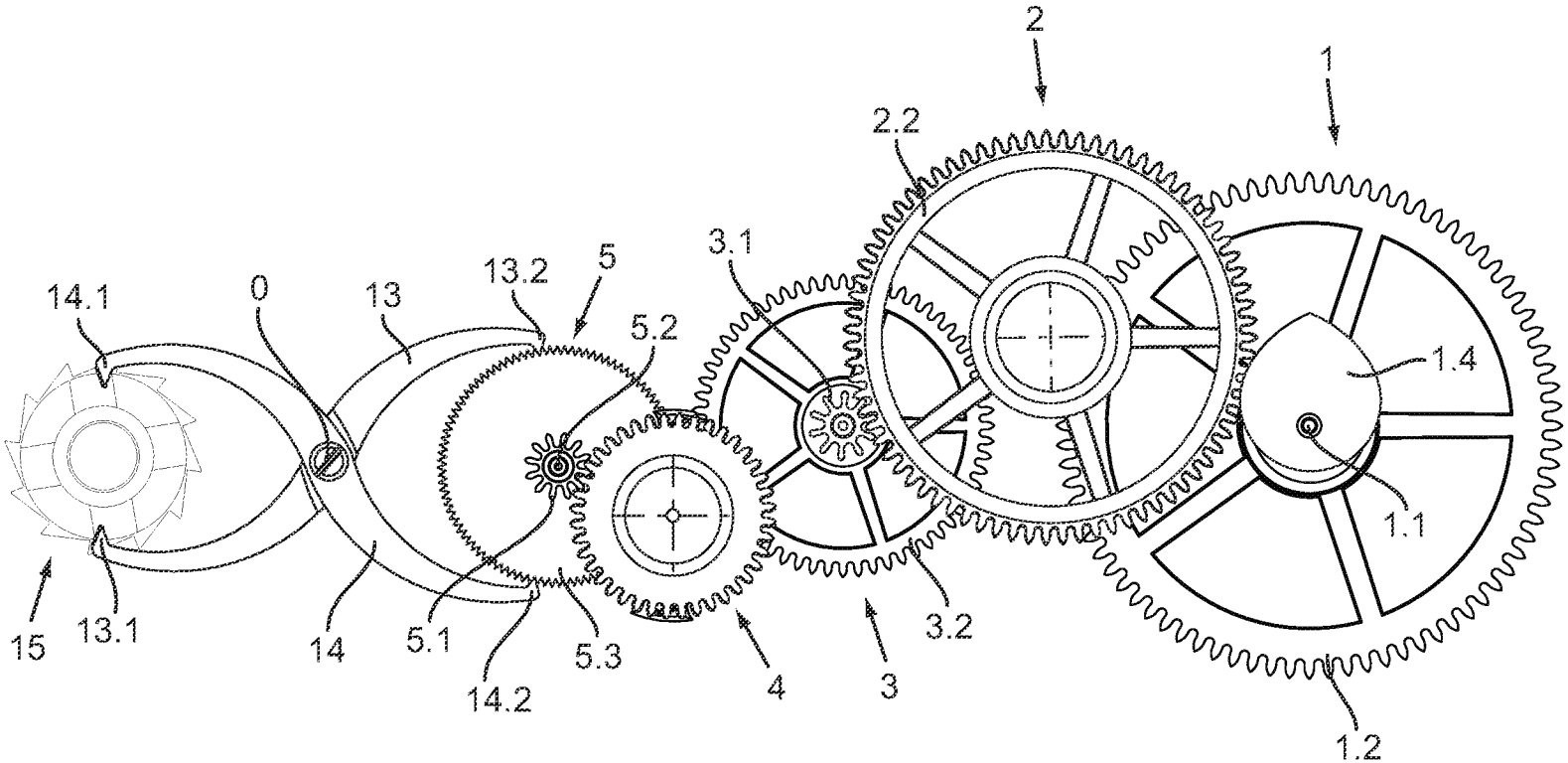
FIG. 3 is a plan view of the bridge side of the chronograph gear train.
Figure 4:
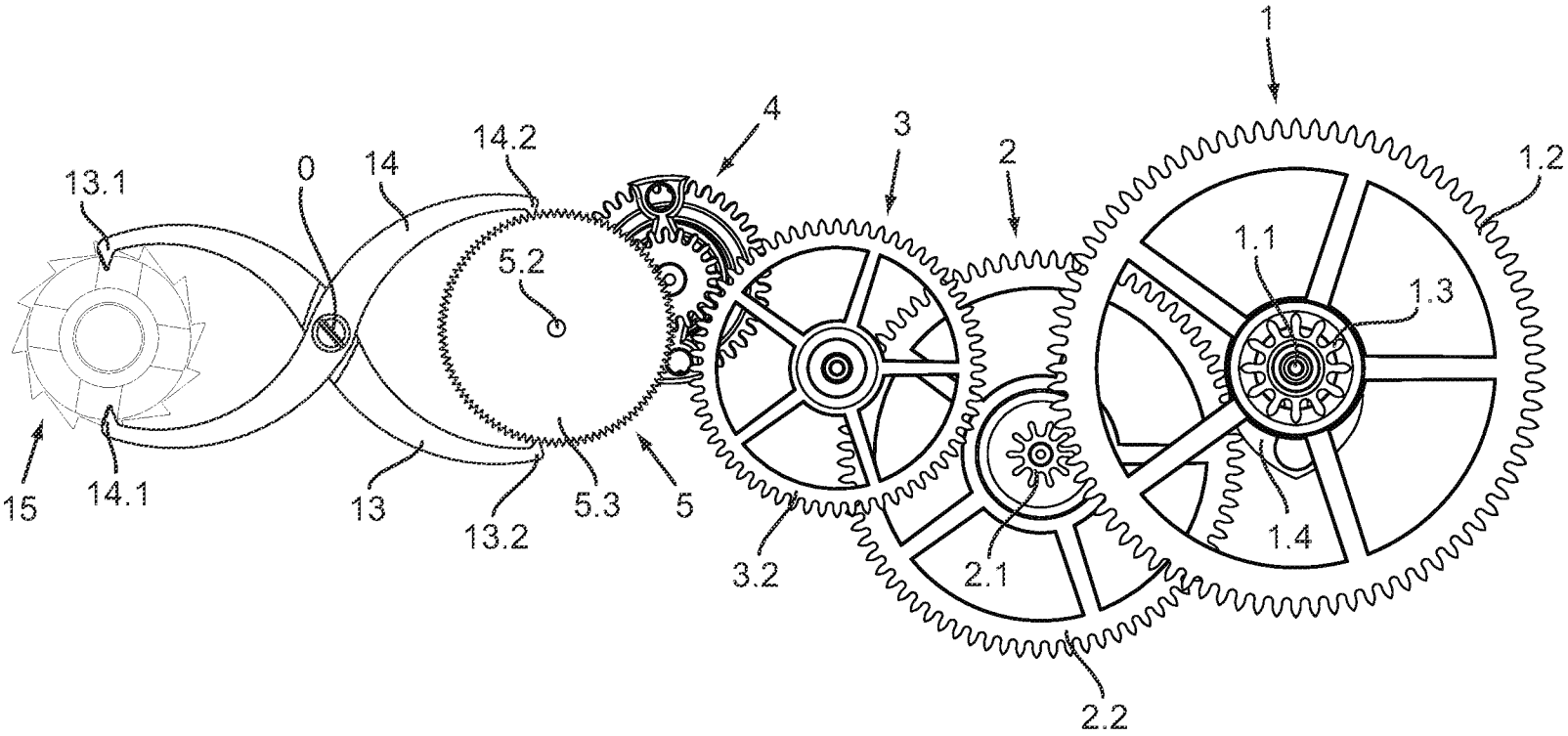
FIG. 4 is a plan view of the dial side of the chronograph gear train.

The chronograph gear train of the present chronograph mechanism is illustrated as a whole more particularly in FIGS. 3 and 4. This chronograph gear train comprises a second-counter mobile 1 comprising, fitted onto a shaft 1.1 and integral with the latter, a plate 1.2, a pinion 1.3 and a resetting core 1.4. This second-counter mobile 1 is designed to be connected kinematically by means of its pinion 1.3 directly to a chronograph mechanism barrel, or mediately, indirectly, to the drive barrel of a timepiece. This chronograph gear train also comprise a third-wheel mobile 2, the pinion 2.1 of which is engaged with the toothing of the plate 1.2 of the second-counter mobile 1. The plate 2.2 of this third-wheel mobile 2 engages with the pinion 3.1 of a hundredths mobile 3. This hundredths mobile 3 comprises a plate 3.2.

The multiplication ratios of this chronograph gear train is such that, if the second-counter mobile 1 is driven at the rate of one revolution per minute, the hundredths mobile 3 performs one revolution per second.

Up to this point these chronograph gears are conventional, and are well known to clock and watch makers.

The essential and novel characteristic of the present chronograph gear train consists in the fact that they also comprise a mobile 4 compensating the backlash, which connects the plate 3.2 of the hundredths mobile kinematically to the pinion 5.1 of an additional or rapid mobile 5. This additional mobile 5 (sometimes called the thousandths mobile hereinafter) comprises a shaft 5.2 which is integral with the pinion 5.1 and a plate 5.3 of this additional or rapid mobile.

The multiplication ratio between the plate 3.2 of the hundredths mobile and the plate 5.3 of the thousandths mobile is such that this additional mobile 5 performs a revolution in a tenth of a second, i.e. ten revolutions per second in the example illustrated. The plate 5.3 of the additional mobile 5 comprises a toothing consisting of a hundred teeth in the example illustrated.

Figure 1:
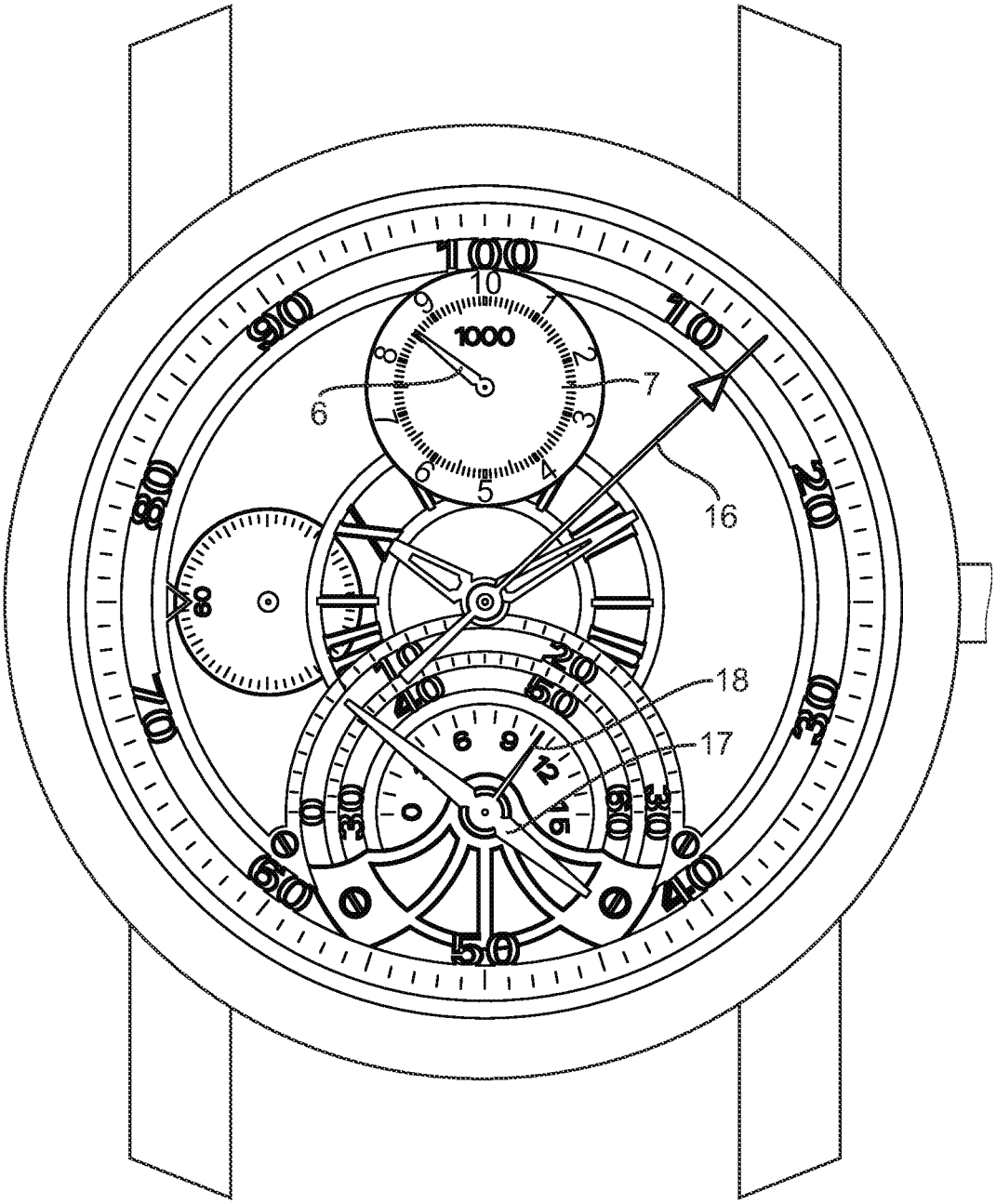
FIG. 1 is a plan view of a timepiece equipped with the chronograph mechanism according to the invention, showing the indicators or displays of this chronograph mechanism.
Figure 2:
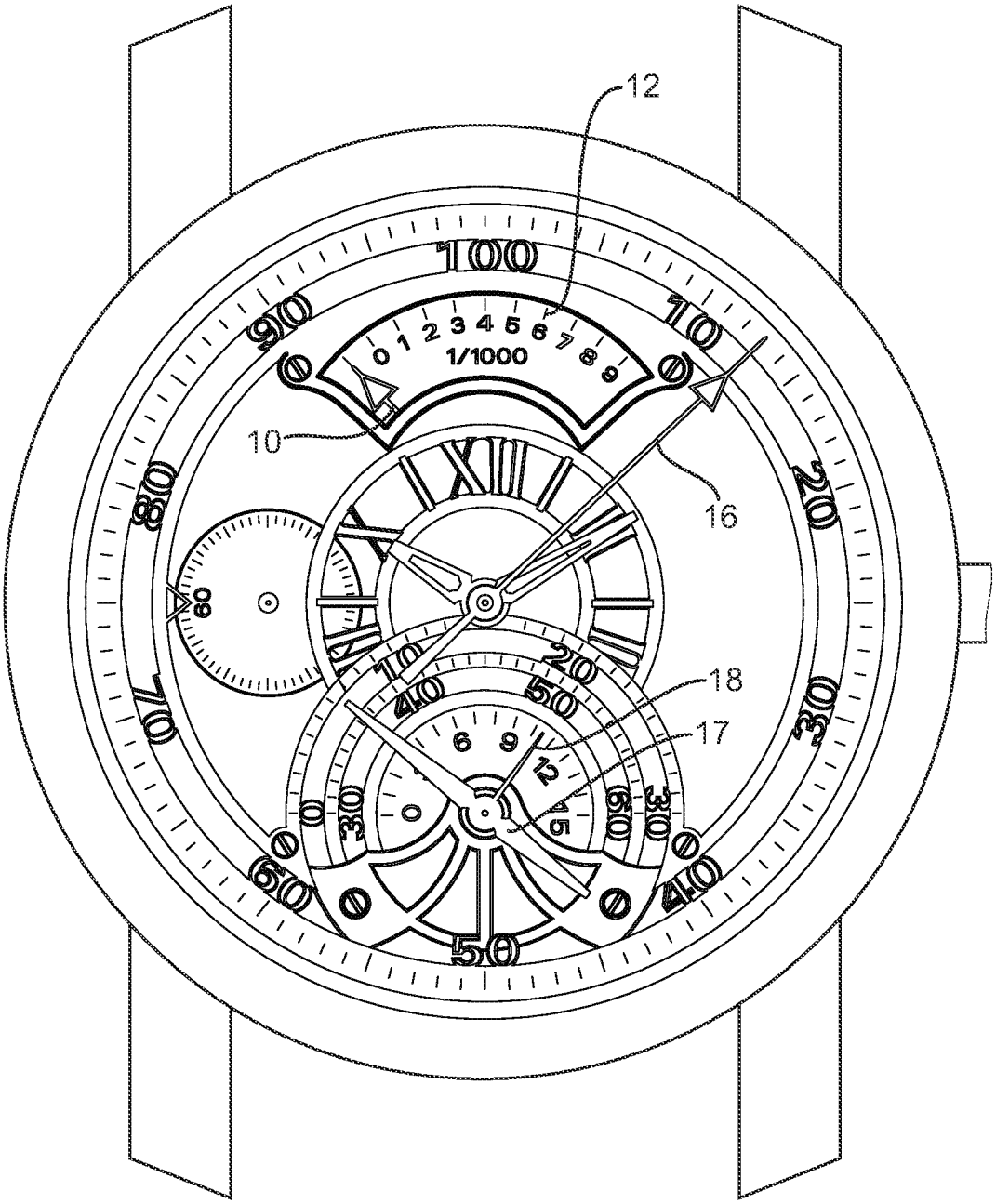
FIG. 2 is a view similar to FIG. 1 with a variant of the chronograph indicators or displays.
Figure 7:
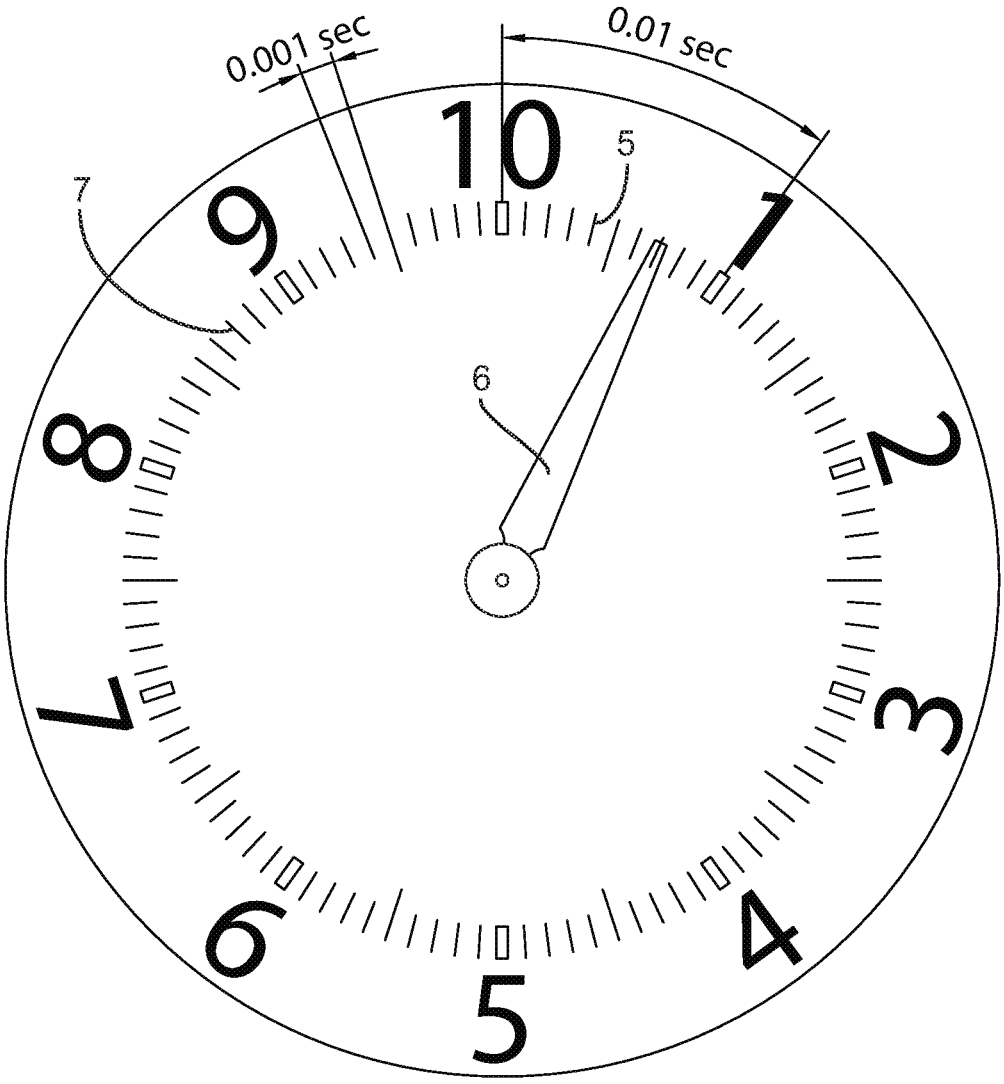
FIG. 7 is a plan view of the indicator for thousandths of a second.

The shaft 5.2 of the additional mobile 5 bears a hand 6 which co-operates with a graduation 7 of the dial, this graduation 7 comprising a hundred divisions which correspond to thousandths of a second. Thus, this display 6, 7 makes it possible to display the hundredths and thousandths of a second, as can be seen in FIGS. 1 and 7. In addition, a central hand 16 indicates the hundredths (and tenths) of a second, a hand 17 with two heads indicates the seconds in the position 6H of the dial, and a hand 18 indicates the minutes.

Figure 5:
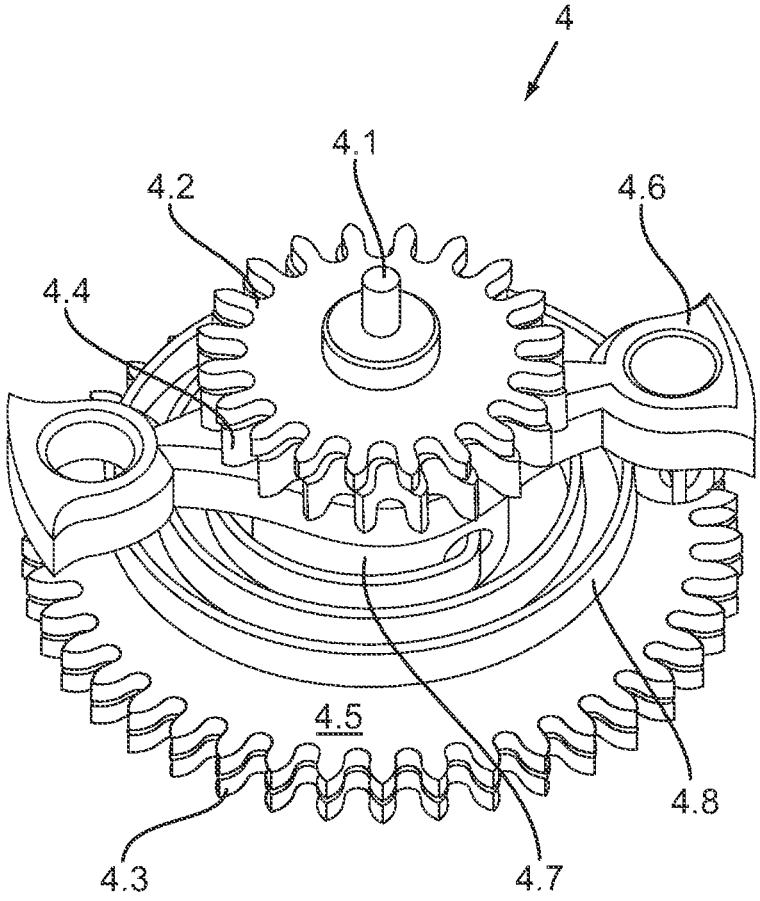
FIG. 5 is a perspective view of the mobile compensating the backlash.
Figure 6:
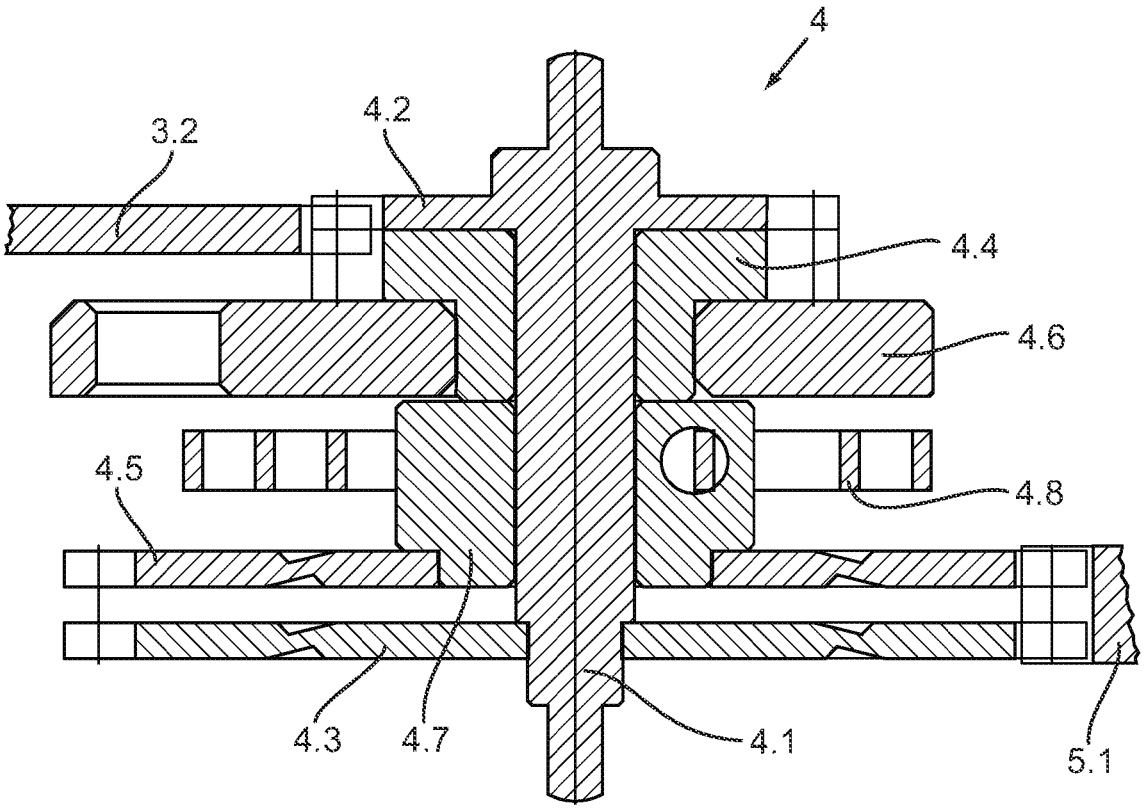
FIG. 6 is a view in axial cross-section of the mobile compensating the backlash.

FIGS. 5 and 6 illustrate a particular embodiment of the mobile 4 compensating the backlash.

This mobile 4 compensating the backlash comprises a central shaft 4.1 which is integral with a support pinion 4.2 and a support plate 4.3.

Sandwiched between the support pinion 4.2 and the support plate 4.3 there are fitted in a non-integral manner, i.e. freely, a free pinion 4.4 and a free plate 4.5.

The free pinion 4.4 has dimensions and a number of teeth which are identical to the support pinion 4.2, and the free plate 4.5 has dimensions and a number of teeth identical to the support plate 4.3.

The free pinion 4.4 is integral with a balance 4.6 whereas the free plate 4.5 is integral with a hub 4.7. A helical spring 4.8 is secured by means of its inner end to the hub 4.7 and by means of its outer end to the balance 4.6.

The free pinion 4.4 and the support pinion 4.2 both engage with the toothing of the plate 3.2 of the hundredths mobile 3, whereas the free plate 4.5 and the support plate 4.3 both engage with the pinion 5.1 of the additional mobile 5.

This mobile 4 compensating the backlash has three specific functions.

The first function is useful during stoppage of the chronograph mechanism. In fact, since the additional mobile 5 can be stopped between two steps, tension in addition to the normal tension may occur in the chronograph gear train. Since the mobile 4 compensating the backlash permits a certain angular offsetting, consisting of at least the value of one step of the pinion 5.2 of the additional mobile 5, the additional tension can be avoided.

The second function is that since the additional mobile 5 is at the end of the gear train and is not subjected to stress, it is important for it to be engaged with a mobile compensating the backlash, otherwise uncontrollable jumps would occur because of the backlash of the gear train and stoppage of the additional mobile 5 would then be random.

More particularly, if during assembly the support plate 4.3 and the free plate 4.5 are coupled by means of the pinion of the thousandths mobile 5.1, then the free pinion 4.4 is rotated by X°, and finally the support pinion 4.2 and the free pinion 4.4 are coupled by means of the plate of the hundredths mobile 3.2, it will be found that the free pinion 4.4 and the free plate 4.5 will tend to return to the neutral position they were in before the free pinion 4.4 was turned by X°, and consequently an angular difference will be created between the support pinion 4.2 and the free pinion 4.4, and also between the support plate 4.3 and the free plate 4.5. This fact compensates the gear backlash.

The third function is to convert the jerky rotation caused by the escapement into continuous rotation by means of the inertia of the additional mobile 5, and complementarily by means of the first function of the mobile 4 compensating the backlash. This third function results in the fact that the thousandth (in this case) will be regulated between each step.

Thus, any variation of the thousandth caused by an impact, or any other disturbances of the watch, will be reset and reinitialised in the following step, thus avoiding any cumulative error.

According to the invention, by incorporating a mobile compensating the backlash in the chronograph gear train, it is possible for the chronometry of a high-precision chronograph to form the basis of a regulator unit which oscillates at a lower frequency (for example from 18000 to 400000), which makes it possible to increase the power reserve of the mechanism. For example, in the examples illustrated, the power reserve of the chronograph mechanism is at least 15 minutes, despite its precision to a thousandth of a second.

According to variants, the mobile compensating the backlash could be produced in a manner different from that previously described.

According to other variants of the chronograph gear train, it is possible to display by means of the hand 6 and the graduation 7 a value other than thousandths of a second, i.e. the second fraction of a second measured and displayed by the chronograph mechanism is different from a thousandth of a second. It is sufficient for this purpose to modify the multiplication ratio between the hundredths mobile 3 and the additional mobile 5 in order for the latter to rotate at a speed other than ten revolutions per second, for example five or twenty revolutions per second; the fraction of a second displayed by the graduation 6, 7 will no longer be a thousandth of a second but another value.

More generally, according to yet other variants, the mobile 4 compensating the backlash can be positioned between the additional mobile 5 and a first mobile which is used to count a first fraction of a second which is different from a hundredth of a second. For example, the first fraction can be a tenth of a second and the second fraction can be a hundredth of a second, the mobile compensating the backlash being positioned between a mobile for tenths of a second and an additional mobile for hundredths. In this case, a chronograph mechanism according to the present invention can use a regulator unit which performs 36,000 alternations per hour, whereas the mechanical counters according to the prior art which are capable of providing precision of a hundredth of a second typically use a regulator unit which performs 360,000 alternations per hour. Consequently for a given precision, the power reserve of a chronograph according to the present invention can be increased substantially, whilst preventing premature wear of its components. It will also be noted that in the preceding example, a single hundredths hand can display the first and second fractions of a second.

According to a variant embodiment, the display of the second fraction of a second could be carried out in a sectorial form. In the example in FIG. 8, the thousandth of a second is displayed by using a snail-wheel with ten arms 8, each having ten levels. The snail-wheel 8 is assembled integrally with the shaft 5.2 of the additional or rapid train 5, in addition to the plate 5.3 with a hundred teeth. When the chronograph is stopped, a sensing pin 9 drops onto the snail-wheel 8, thus indicating the precise position. A hand 10 which is wedged onto the shaft 11 of the sensing pin 9, and can be seen on the dial side, then indicates instantaneously the thousandth of a second on a graduation 12. According to another variant embodiment, the arms of the snail-wheel 8 are not divided into ten levels, but are smooth, which makes it possible to display accuracies which are even better than a thousandth of a second.

Figure 8:
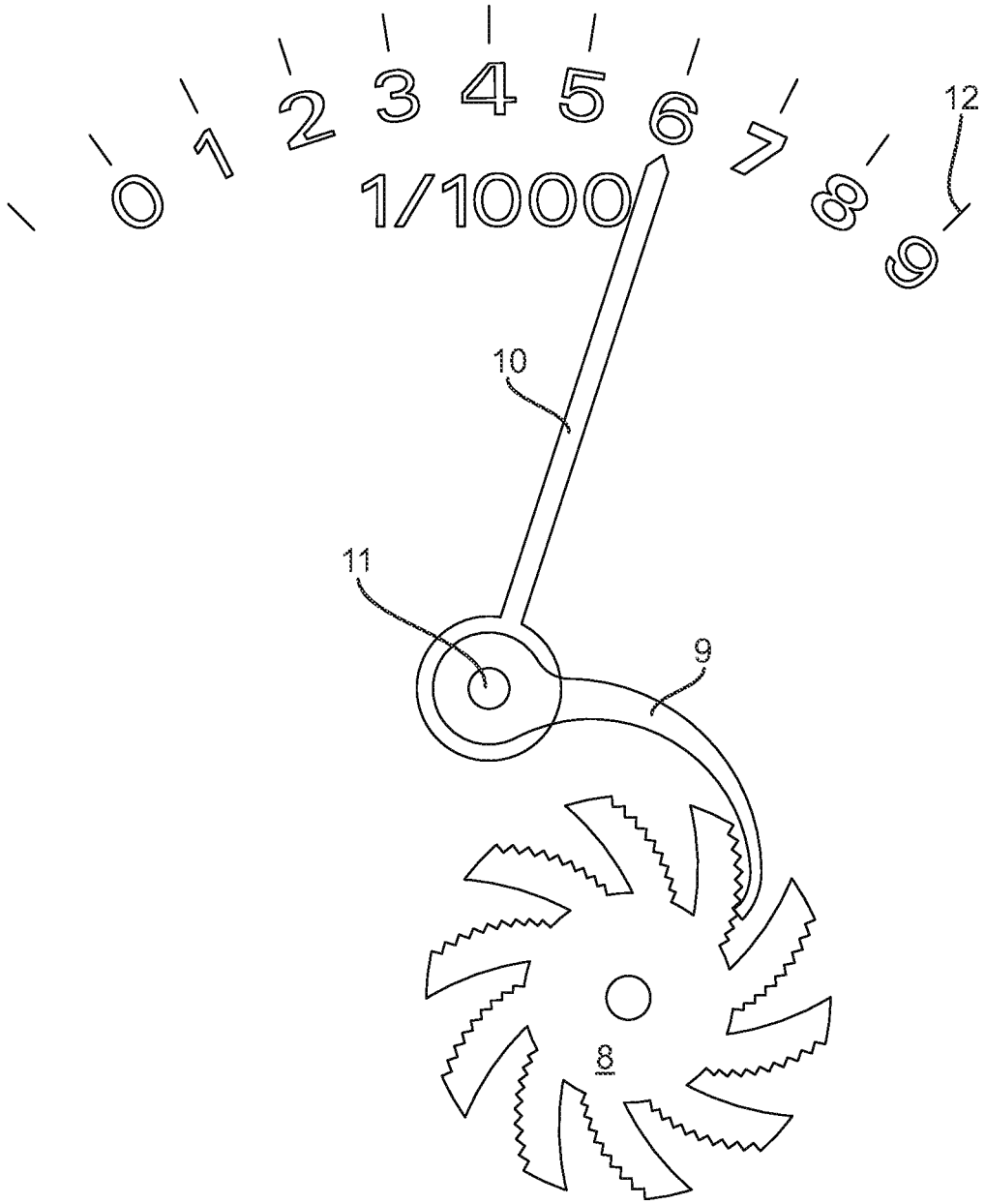
FIG. 8 is a plan view of a variant of the indicator for thousandths of a second.

When the chronograph is in the "resetting" phase, the sensing pin 9 is raised, and the hand 10 is placed on a neutral area of the graduation 12 (before the zero in FIG. 8).

When a sectorial display as previously described is selected, tenths and hundredths of a second will be displayed by a hand which is integral with the shaft of the hundredths mobile 3, which co-operates with a corresponding graduation supported by the dial.

The chronograph mechanism also comprises a control device with one or two push-buttons which control the starting, stoppage and resetting of the chronograph mechanism. This control device is conventional, and can be of the column wheel or cam type.

In the case of the present chronograph mechanism, this control device also comprises clips 13, 14 which are pivoted at O, and each comprise a control sensing pin 13.1, 14.1 which co-operates with the column wheel 15 or the cam of the control device and a retention nose 13.2, 14.2 which co-operates with the toothing of the plate 5.3 of the additional mobile, in order to keep it stopped in a specific stable position.

Figure 9:
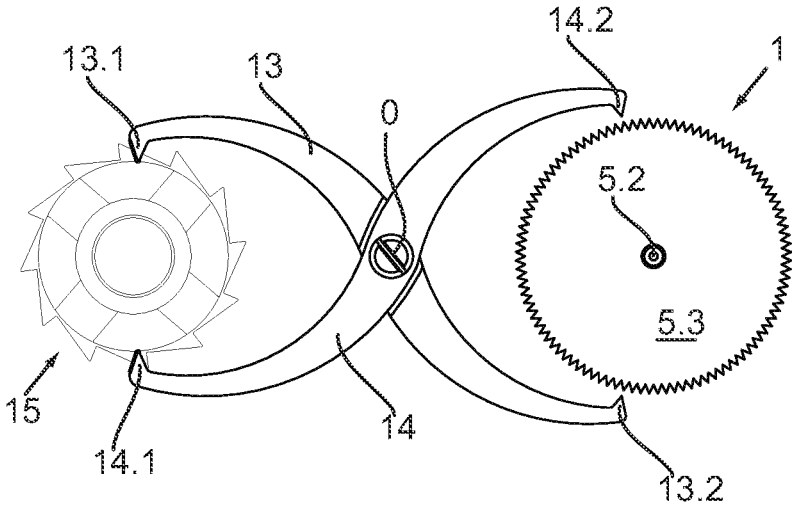
FIG. 9 illustrates in plan view on the dial side a device for locking the additional mobile in the start position of the chronograph.
Figure 10:
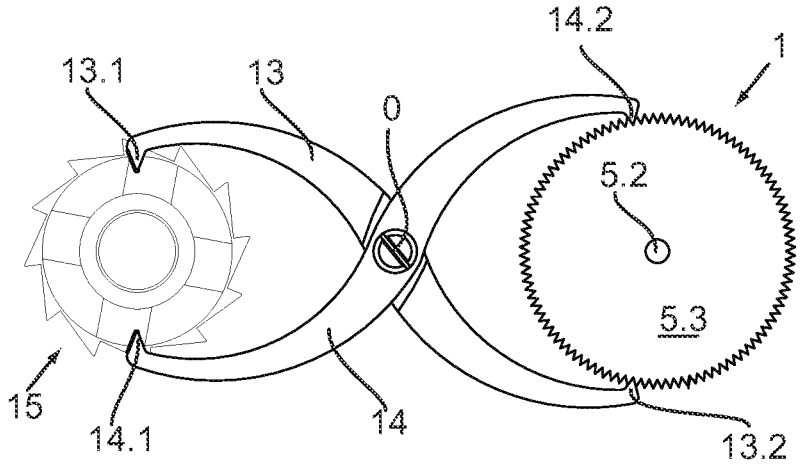
FIG. 10 is a view similar to FIG. 9 in the stop position of the chronograph.
Figure 11:
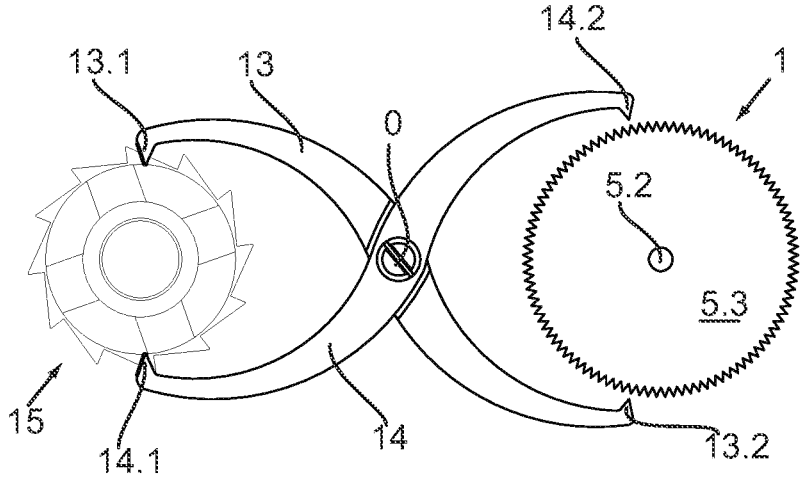
FIG. 11 is a view similar to FIG. 9 in the resetting position of the chronograph.

FIG. 9 illustrates the clips 13, 14 in the start position of the chronograph. FIG. 10 illustrates the clips 13, 14 in the stop position of the chronograph, and FIG. 11 illustrates the position of the clips 13, 14 in the resetting position of the chronograph.

The column wheel 15 can be the same as that of the chronograph mechanism, or it can be an independent column wheel, but in this case actuated by the same push-button of the control device.

According to a variant embodiment, the clips 13, 14 can be replaced by a locking device which is controlled by the column wheel 15.

In the embodiment described of the chronograph mechanism, the additional mobile 5 or rapid mobile returns to the zero position by means of the ratio which exists between the hundredths mobile 3 and the additional mobile 5, and because of the fact that the chronograph gear train rotate to return to zero.

According to a variant, the mobile 4 compensating the backlash and the additional mobile 5 can be assembled with a conventional chronograph gear train, but in this case it will be necessary to add a lantern core onto the additional mobile in order to ensure that it is reset by a hammer.

A mobile compensating the backlash as previously described could also be used in other applications where it is desirable to compensate backlash and/or avoid additional tension in the gear train of a horological movement.

The invention claimed is:

1. A chronograph mechanism comprising:

a control device;

a chronograph gear train configured to be driven directly or indirectly by a barrel and regulated by a regulator unit, the chronograph gear train comprising a second-counter mobile and a mobile with a first precision corresponding to a first fraction of a second, and the regulator unit oscillating at a frequency corresponding to the first precision; and at least one indicator which displays the seconds and first fractions of a second of the duration measured, wherein the chronograph gear train also comprises an additional mobile with a second precision corresponding to a second fraction of a second, which is driven and regulated by the mobile for the first fraction of a second via a mobile compensating the backlash, and wherein the chronograph mechanism further comprises an indicator for the second fractions of a second of the duration measured, the second fractions of a second being smaller than the first fractions of a second, the indicator for the second fractions of a second being actuated by said additional mobile.

2. The chronograph mechanism according to claim 1, wherein the mobile with the first precision is a mobile for hundredths of a second.

3. The chronograph mechanism according to claim 2, wherein the additional mobile is a mobile for thousandths of a second.

4. The chronograph mechanism according to claim 3, wherein the additional mobile comprises a pinion which engages with the mobile compensating the backlash and a plate comprising toothing with a hundred teeth; and in that this additional mobile is driven at a rate of ten revolutions per second.

5. The chronograph mechanism according to claim 1, wherein the shaft of the additional mobile supports a hand which co-operates with a graduation which is supported by a dial.

6. The chronograph mechanism according to claim 1, wherein the shaft of the additional mobile supports a snail-wheel comprising ten arms; and in that the mechanism comprises a sensing pin which co-operates with the levels of the snail-wheel, and is integral with a shaft which supports a hand which co-operates with a graduation in the form of a sector supported by a dial.

7. The chronograph mechanism according to claim 6, wherein each arm of the snail-wheel has ten levels.

8. The chronograph mechanism according to claim 1, wherein the mobile compensating the backlash comprises a central shaft which is integral with a support pinion and a support plate; a free pinion and a free plate which is fitted in an idle manner on the central shaft between the support pinion and the support plate; this free pinion being identical to the support pinion, and the free plate being identical to the support plate; and in that a helical spring connects the free pinion to the free plate.

9. The chronograph mechanism according to claim 8, wherein the support plate and the free plate engage with a pinion of the additional mobile, whereas the free pinion and the support pinion engage with a plate of the mobile with the first precision.

10. The chronograph mechanism according to claim 1, wherein the indicator for the first fractions of a second is separated from the indicator for the second fractions of a second.

11. The chronograph mechanism according to claim 1, wherein the same indicator indicates the first fractions of a second and the second fractions of a second.

12. A timepiece, comprising a chronograph mechanism according to claim 1.

* * * * *